US005852345A

United States Patent [19]

Armini

[11] Patent Number: 5,852,345

[45] Date of Patent: Dec. 22, 1998

[54] ION SOURCE GENERATOR AUXILIARY DEVICE FOR PHOSPHORUS AND ARSENIC BEAMS

[75] Inventor: Anthony J. Armini, Manchester, Mass.

[73] Assignee: Implant Sciences Corp., Wakefield, Mass.

[21] Appl. No.: 904,494

[22] Filed: Aug. 1, 1997

Related U.S. Application Data

[63] Continuation-in-part of Ser. No. 742,896, Nov. 1, 1996, Pat. No. 5,808,416.

[51] Int. Cl.[6] ..... H01J 7/24

[52] U.S. Cl. ..... 315/111.81; 315/111.91; 315/111.21; 250/423 R; 204/192.34

[58] Field of Search ..... 315/111.21, 111.71, 315/111.81, 111.91; 313/231.31; 250/423 R; 204/192.34, 298.36

[56] References Cited

U.S. PATENT DOCUMENTS

| | | | |
|---|---|---|---|
| 3,689,766 | 9/1972 | Freeman | 250/49.5 T |
| 3,774,026 | 11/1973 | Chavet | 250/41.9 ME |
| 5,089,746 | 2/1992 | Rosenblum et al. | 315/111.81 |
| 5,309,064 | 5/1994 | Armini | 315/111.81 |

*Primary Examiner*—Don Wong
*Assistant Examiner*—Haissa Philogene
*Attorney, Agent, or Firm*—Don Halgren

[57] ABSTRACT

The present invention comprises an ion source apparatus for producing an ion beam from a solid material of arsenic or phosphorus. The ion source includes a plasma chamber having an inlet orifice and an outlet orifice wherein a non-toxic carrier gas is inputted into the plasma chamber. A means for generating a gas plasma is arranged within the plasma chamber and an electrically insulated platform is also arranged within the plasma chamber. A heatable wafer of solid source material of a metal phosphide or arsenide is attached to the platform, for conversion upon heating, into an ion beam.

14 Claims, 3 Drawing Sheets

ION SOURCE GENERATOR AUXILIARY DEVICE FOR PHOSPHORUS AND ARSENIC BEAMS

BACKGROUND OF THE INVENTION

1. Field of the Invention

The present invention relates to ion sources utilized in ion beam generating equipment. More particularly, this invention relates to an arrangement for minimizing hazards from feed gases in ion source generators, and is an improvement over my earlier U.S. Pat. No. 5,309,064, and is a Continuation-In-Part Application of my co-pending U.S. patent application Ser. No. 08/742,896 filed Nov. 1, 1996, now U.S. Pat. No. 5,808,416 each of which are incorporated herein by reference, in their entirety.

2. Prior Art

Ion sources in the semi-conductor industry are utilized to generate intense ion beams of phosphorous and arsenic, for doping silicon microcircuits.

U.S. Pat. No. 3,689,766 to Freeman shows an ion beam source utilized for implantation on an industrial production scale including means for automatically moving targets through the ion beam.

U.S. Pat. No. 3,774,026 to Chavet discloses an ion optical system for use with a magnetic prism so that its ion beam can converge in the vertical plane for effective focusing thereof.

An ion source generally consists of a plasma chamber (also called an arc chamber) from which a beam of positive ions may initially be extracted, and from which it then may be accelerated. The actual physics and technology of ion sources may be uncovered in D. Aiken, "Ion Sources", Chapter 2, Ion Implantation Techniques, H. Ryssel and H. Glaswischnig, eds., Springer-Verlag, Berlin (1982), which is hereby incorporated by reference.

The structure of a typical ion source such as the known "Freeman" type, consists of a cylindrically shaped plasma chamber which contains a tungsten filament, heatable by electric current, so as to thermionically emit electrons.

A gas may be introduced into the plasma chamber at a pressure of about $10^{-3}$ Torr, which forms a plasma discharge between the plasma chamber and the filament, which is biased at about minus 100 V. Positive ions from this plasma discharge are then electrostatically extracted from the plasma and are accelerated through an aperture in the extraction electrode wall.

In generating phosphorous and arsenic ion beams, phosphine ($PH_3$) and arsine ($AsH_3$), which are bottled gas feeds, are typically used because they yield the best control and give large currents of pure $^{31}P+$ and $^{75}As+$ beams, respectively.

Arsine and phosphine gases, however, are two of the most toxic and dangerous gases known. Arsine is particularly dangerous because it is invisible in air and is already above lethal concentrations before humans can detect its odor. Phosphine is only slightly less toxic.

Alternately, some ion sources use solid elemental phosphorous and arsenic which is vaporized in-situ in a heated chamber prior to introduction into the ion source. While this feed material yields large beam currents, the technique suffers from long heating times and many present toxic cleanup and disposal problems.

Other gases have been used, i.e. the pentafluorides, $PF_5$ and $AsF_5$, which are convenient bottled gases, less toxic than arsine or phosphine, but they suffer poor $^{31}P+$ and $^{75}As+$ ion beam currents, and, for this reason, they are seldom used in a production environment.

My U.S. Pat. No. 5,309,064 describes an ion source generator having an auxiliary chamber which contains chips of barium, calcium or cerium to provide a reduction reaction of feed gas passing through the chamber and into the main chamber where the ion beams are generated, minimizing many of the problems of the prior art.

My above-identified U.S. application, Ser. No. 08/742,896, now U.S. Pat. No. 5,808,416 teaches an ion source arrangement wherein the solid reactant is selected from the group consisting of metal phosphides or metal arsenides, and wherein the feed gas is driven through the solid reactant, the feed gas being selected from the group consisting of oxygen, fluorine or chlorine containing gases.

It is yet however, the principal object of the present ion source invention to still improve upon the prior art by providing further alternative ion sources for $^{31}P+$ and $^{75}As+$ and other ions which do not use feed gases containing the toxic and dangerously reactive $PF_5$ and $AsF_5$ gases, which are non- toxic such as argon.

It is a further object of the present invention to provide a novel method of regulating the temperature of unique ion generating compounds in a plasma chamber, and thus controlling the ion beam output.

BRIEF SUMMARY OF THE INVENTION

The present invention comprises an ion generating device which may have an plasma chamber of the "Freeman" type or the "Bernas" type, which does not need an adjacent auxiliary chamber. The plasma chamber is generally cylindrically shaped, having walls made of for example: graphite, molybdenum or stainless steel.

The plasma chamber has an upper and lower end. A discharge orifice is disposed in the wall of the plasma (or arc) chamber. The orifice is a longitudinally extending slot, having dimensions for example, of about 60 mm by about 2 mm. A tungsten filament is disposed between the upper and lower ends of the plasma chamber, in alignment with and in proximity with the discharge orifice. The tungsten filament is insulatively disposed with respect to the upper and lower ends of the plasma chamber.

An inlet gas line is in fluid communication with the distal end of the plasma chamber. The inlet gas line supplies the inert gas argon, instead of a toxic reactive gas, from a source and into the plasma chamber. An electrically conductive platform holder is insulatively supported off of a wall inside of the plasma chamber. A wafer of a metal phosphide or metal arsenide compound such as GaAs (Gallium Arsenide), or GaP (Gallium Phosphide) having dimensions of about 1 cm.×1 cm.×0.5 mm., is secured to the platform holder. Other embodiments of the wafer may include metal arsenide and phosphide compounds which decompose at temperatures of approximately 900° C. and above and emit arsenic and phosphorus gas such as platinum and chromium may also be utilized. The platform holder is in electrical communication with a variably adjustable DC power supply. The adjustable power supply is connected to the plasma chamber. The platform holder is negatively biased with respect to the plasma chamber.

The plasma chamber is heated by a current through the tungsten filament. The arc chamber typically operates at a temperature in the range of about 1000° C.

In operation, the argon carrier gas is delivered to the plasma chamber through the side inlet therein. The adjustable DC power supply is activated to energize and heat the tungsten filament extending across the plasma chamber. An electrical arc is formed between the chamber and the filament. A gas plasma may be generated in the plasma chamber from the argon gas by its reaction with the hot filament and the arc discharge.

The gallium arsenide (or phosphide) wafer is heated indirectly by optical radiation from the heated filament which injects arsenic (or phosphorus) gas into the plasma. The gallium arsenide wafer has a negative bias which attracts positive ions from the plasma generated within the plasma chamber, thus bombarding the wafer with a flux of high energy ions, thus causing an additional temperature rise of the wafer. By regulating the power impinging upon the wafer by controlling the DC power supply, the temperature of the wafer may be controlled to produce the optimum gas pressure of arsenic or phosphorus within the arc/plasma chamber. The control of the bias power may therefore be utilized to regulate the arsenic or phosphorus ion beam current.

The invention thus comprises an ion source for producing an ion beam from a solid material comprising a plasma chamber having an inlet orifice for a carrier gas and an outlet orifice for an ion beam discharge, a carrier gas input into the plasma chamber, a means for generating a gas plasma within the plasma chamber, an electrically insulated platform arranged within the plasma chamber and a wafer of solid source material attached to the platform, which wafer upon heating thereof, is converted into an ion beam. The solid source material may preferably selected from the group comprising metal arsenides and metal phosphides. The metal arsenides or metal phosphides is an arsenide or phosphide selected from the group consisting of gallium, indium, tin, chromium, nickel, cobalt and platinum. A means for heating the source material is a negative bias voltage applied to the platform to attract positive ions from the gas plasma. A further means to heat the source material may include an energizable filament arranged adjacent the platform on which the source material is disposed. A yet further means to heat the source material may comprise a negative bias voltage applied to the insulated platform. The carrier gas may be selected from the group comprised of: nitrogen, neon, argon, krypton and xenon. The means for generating the gas plasma may comprise an arc discharge within the plasma chamber. The means for generating the gas plasma may also comprise a radio frequency discharge from the filament. The negative bias voltage is regulated from a signal inversely proportional to an extraction from the ion source.

The invention also includes a method of generating an ion beam from a solid source within a plasma chamber, comprising the steps of: introducing the solid source material into the plasma chamber, introducing a carrier gas into the plasma chamber, generating a gas plasma within the plasma chamber, heating the solid source material within the chamber so as to evaporate a portion thereof into the gas plasma; and extracting an ion beam from an exit orifice in the plasma chamber. The method includes selecting the carrier gas from the group consisting of nitrogen, neon, argon, krypton and xenon. The method may also include selecting the solid source material from the group consisting of metal arsenides and metal phosphides and regulating the ion beam current by regulating the negative bias voltage supplied to the solid source material.

BRIEF DESCRIPTION OF THE DRAWINGS

The objects and advantages of the present invention will become more apparent when viewed in conjunction with the following drawings in which.

DESCRIPTION OF THE PREFERRED EMBODIMENTS

Figure 1:
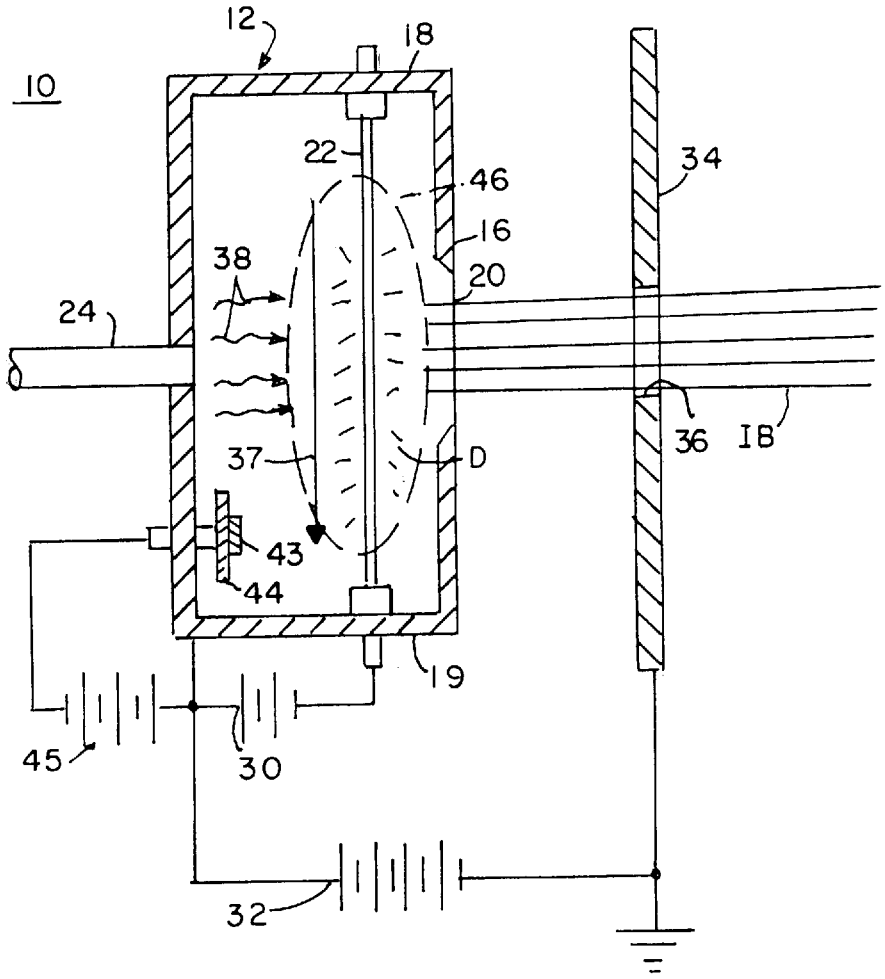
FIG. 1 is a cross-sectional view of an ion source generator constructed according to the principles of the present invention.

Referring now to the drawings in detail, and particularly to FIG. 1, there is shown an ion source generator 10 comprised of a generally cylindrically shaped plasma chamber 12. The plasma chamber 12 has a front wall 16 and end walls 18 and 19, which chamber is preferably made of graphite or molybdenum.

A discharge orifice 20 is disposed through the front wall 16 of the arc chamber 12. The orifice 20 is a longitudinally extending slot, having a lengthwise dimension of about 30 to 60 mm, and a width of about 2 mm.

A tungsten filament 22 is insulatively disposed between the end walls 18 and 19, in longitudinal alignment with, and close proximity to the discharge orifice 20 in the front wall 16. An inlet gas feed line 24 is in fluid communication with the distal end of the plasma chamber 12, as shown in FIG. 1.

The plasma chamber 12 is heated to a temperature of for example, of about 900°–1000° C. preferably by a current flow through the tungsten filament 22 therein. The tungsten filament 22 is powered by an adjustable direct current source 45, typically for example, about 3 to 5 volts DC. at a current of for example, about 50 to 200 Amp.

A feed gas such as argon (Ar) passes from the feed line 24 from a source, not shown, and into the plasma chamber 12 at a pressure of about $10^{-3}$ Torr.

The ion source 10 is operated by first forming an argon plasma in the plasma chamber 12. The plasma is formed when all four constituents are present, that is, the carrier gas 38 from the feed line 24, electron emission "D" from the hot filament 22, an arc voltage 30, between the filament 22 and the plasma chamber 12, and a magnetic field 37, of for example, about 100 gauss, arranged parallel to the filament 22. A wafer of GaAs 43 approximately 1 cm.×1 cm.×0.5 mm. in size, is mounted on an electrically conducting platform holder 44 which is negatively biased relative to the anode, using an adjustable DC power supply 45. During operation of the source generator 10, a gas plasma is formed from the argon carrier gas entering through the feed line 24 and the arc between the filament 22 and the plasma chamber 12. The GaAs wafer 43 is indirectly heated by optical radiation from the filament 22. The negative bias on the GaAs wafer 43 attracts positive ions from the plasma 46, thus bombarding the GaAs wafer 43 with a flux of high energy ions and causing an additional temperature rise of the GaAs wafer 43. By regulating the bias power impinging on the GaAs wafer 43, this arrangement permits the "tuning" of the temperature of the GaAs wafer 43 to produce an optimum gas pressure of arsenic in the plasma chamber. This bias power may therefore be utilized to control the arsenic beam current.

Once the arsenic gas pressure begins to increase, the argon gas flow may be reduced to zero or near zero thus forming a pure arsenic plasma. The arsenic ions IB in the plasma is extracted through an orifice 36 in the extraction electrode 34. This extraction voltage is provided by a direct current voltage source 32 which is typically for example, about 60,000 to 80,000 volts. The ion beam IB thus generated may then be utilized in any commercial ion implanter such as Eaton NV10-160.

Figure 2:
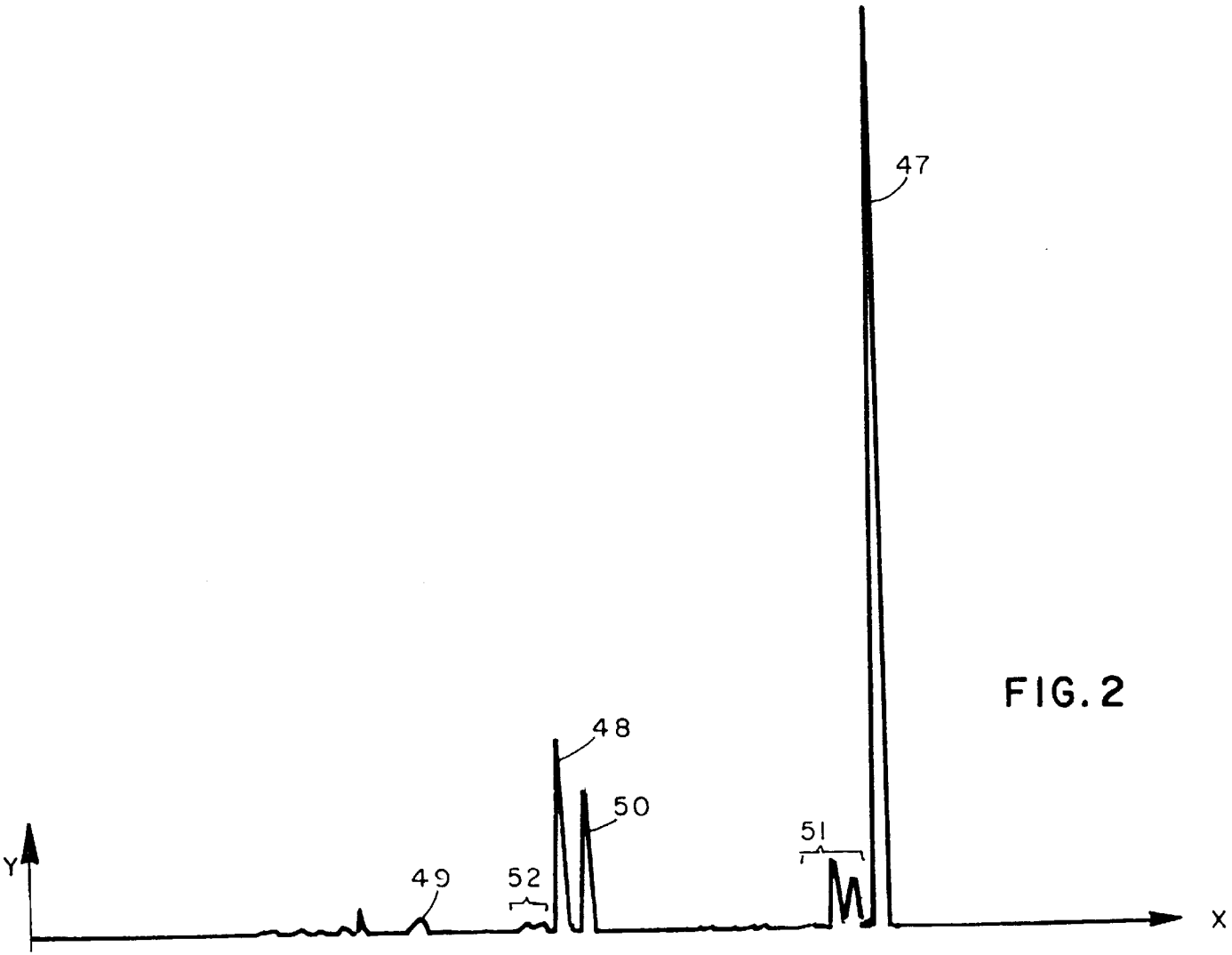
FIG. 2 shows an arsenic ion beam "mass spectrum" obtained from a semiconductor ion implanter, such as an Eaton Corporation model NV 10-160 the ion beam chamber containing a large peak (47) of the $As^{75}$ ion as well as smaller peaks consisting of $As^{+}$(47), $As^{++}$(48), and $As^{++}$ (49)

FIG. 2 shows a "mass spectrum" obtained from a semiconductor ion implanter, such as a Eaton Corporation model NV10-160, the ion beam chamber containing a large peak (47) of the $As^{75}$ ion as well as smaller peaks consisting of $As^{+}$(47), $As^{++}$(48), and $As^{++}$(49). The plasma and subsequently the ion beam spectrum emitted contains the large peak (47) of the $As^{75}$ ion as well as smaller peaks consisting of $As^{+}$(47), $As^{++}$(48), and $As^{++}$(49). The peak due to the argon gas is designated 50. $Ga^{69}$ and $Ga^{70}$ are designated 51. $Ga^{69++}$ and $Ga^{70++}$ are designated 52.

In FIG. 2, the vertical axis (y) represents the ion beam current, and the horizontal axis (x) represents increasing atomic mass units.

An example of arsenic ion beam generation: An Eaton NV10-160 ion implanter using the following ion source perameters:

| | |
|---|---|
| Carrier Gas | Argon |
| Gas Inlet Pressure | $10^{-3}$ Torr |
| Filament voltage | 2.4 Volts |
| Filament current | 160 Amps |
| Arc Voltage | 100 Volts |
| Arc Current | 2.5 Amps |
| Bias Voltage | 250 Volts |
| GaAs Wafer Size | 1 $cm^2$ |
| Extraction Voltage | 80 kv |

The above conditions produced an $AS^{75}$ ion beam current after a mass analysis of 6 mA. The entire ion beam spectrum from mass 1 to 130 is shown in FIG. 2. In this spectrum, the horizontal axis is proportional to the square root of the atomic mass unit (AMU), and the vertical axis is the measured ion beam current. The arsenic is represented by peaks $As_{+}$, $As_{++}$ and As+++. The peak due to the argon feed gas is to the right of the As++. The peak to the left of the As+ is $Ga_{69}$ and $Ga_{70}$, and the group to their left is $Ga_{69++}$ and $Ga_{70++}$.

An example of a phosphorous ion beam generated utilizing the present invention in conjunction with an Eaton Corporation NV10-160 ion implanter used the following parameters:

| | |
|---|---|
| Carrier Gas | Argon |
| Gas Inlet Pressure | $10^{-3}$ Torr |
| Filament voltage | 2.4 Volts |
| Filament current | 160 Amps |
| Arc Voltage | 100 Volts |
| Arc Current | 2.5 Amps |
| Bias Voltage | 250 Volts |
| GaP Wafer Size | 1 $cm^2$ |
| Extraction Voltage | 80 kv |

Figure 3:
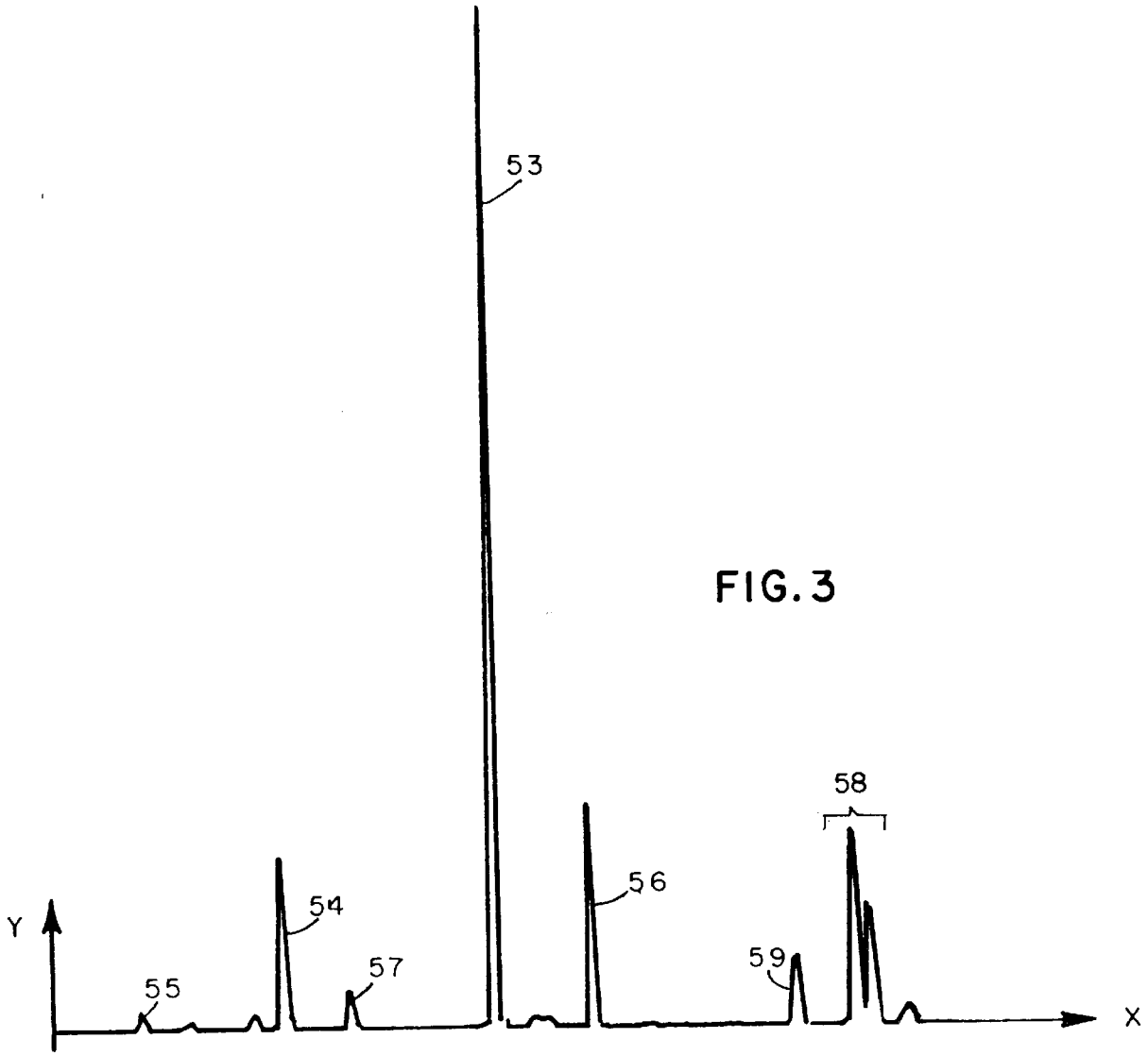
FIG. 3 shows a phosphorus ion beam "mass spectrum" obtained from a semiconductor ion implanter, such as an Eaton Corporation model NV 10-160 the ion beam chamber emitter containing a large peak (53) of the $P^{+}$ion as well as smaller peaks consisting of $P^{++}$(54), and $P^{+++}$(55).

These conditions produced a $P^{31}$ ion beam current after a mass analysis of 7 mA. The entire ion beam spectrum from mass 1 to 130 is shown in FIG. 3. The phosphorus is represented by peaks $P^{+}$ (53), $P^{++}$(54) and $P^{+++}$(55). The argon gas carrier is represented by the peaks 56 and 57 to the left and right of $P_{+}$. The higher peaks to the right of the higher gas carrier peak is $Ga_{69}$ and $Ga_{70}$ (58 and 59).

The ion beam output may be thus controlled by the feedback of a signal to the bias power supply 45 which is inversely proportional to the ion beam extraction current. If the extraction beam current falls, the feedback signal will increase the bias and thus increase the heating of the GaAs or GaP wafer. If the ion beam extraction current increases, the bias voltage is driven down, and the heating of the GaAs or GaP wafer is decreased. A desired ion beam extraction current may be preset to a desired level, and the feedback circuit automatically adjusts the bias voltage to maintain the preset ion beam extraction current.

I claim:

1. An ion source apparatus for producing an ion beam from a solid material comprising:

a plasma chamber having an inlet orifice and an outlet orifice;

a carrier gas input into said plasma chamber through said inlet orifice;

an electrically insulated platform arranged within said plasma chamber;

a wafer of solid source material attached to said platform;

a means for generating a gas plasma within said plasma chamber; and a means for heating said wafer of solid source material in said gas plasma, to permit the generation of an ion beam in said plasma, for subsequent discharge through said outlet orifice.

2. An ion source apparatus as recited in claim 1, wherein said solid source material is selected from the group comprising metal arsenides and metal phosphides.

3. An ion source apparatus as recited in claim 2, wherein said metal arsenides or metal phosphides is an arsenide or phosphide selected from the group consisting of gallium, indium, tin, chromium, nickel, cobalt and platinum.

4. An ion source apparatus as recited in claim 1, wherein said means for heating said source material is a negative bias voltage applied to said platform to attract positive ions from said gas plasma.

5. An ion source apparatus as recited in claim 1, including a further means to heat said source material comprising an energizable filament arranged adjacent said platform on which said source material is disposed.

6. An ion source as recited in claim 1, including a further means to heat said source material which comprises a negative bias voltage applied to said insulated platform.

7. An ion source as recited in claim 1, wherein said carrier gas is selected from the group comprised of: nitrogen, neon, argon, krypton and xenon.

8. An ion source as recited in claim 4, wherein said means for generating said gas plasma comprises an arc discharge within said plasma chamber.

9. An ion source as recited in claim 4, wherein said means for generating said gas plasma comprises a radio frequency discharge.

10. An ion source as recited in claim 6, wherein said negative bias voltage is regulated from a signal inversely proportional to an extraction from said ion source.

11. A method of generating an ion beam from a solid source within a plasma chamber, comprising the steps of:

introducing said solid source material into said plasma chamber;

introducing a carrier gas into said plasma chamber;

generating a gas plasma within said plasma chamber;

heating said solid source material within said chamber so as to evaporate a portion thereof into said gas plasma; and extracting an ion beam from an exit orifice in said plasma chamber.

12. The method of generating an ion beam as recited in claim 11, including:

selecting the carrier gas from the group consisting of nitrogen, neon, argon, krypton and xenon.

13. The method of generating an ion beam as recited in claim 11, including:

selecting said solid source material from the group consisting of metal arsenides and metal phosphides.

14. The method of generating an ion beam as recited in claim 12, including:

regulating the ion beam current by regulating the negative bias voltage supplied to the solid source material.

* * * * *